US008364317B2

(12) United States Patent
Park et al.

(10) Patent No.: US 8,364,317 B2
(45) Date of Patent: Jan. 29, 2013

(54) AIR CONDITIONER AND METHOD OF OPERATING THE SAME

(75) Inventors: Hee Woong Park, Changwon-si (KR); Dong Ju Kim, Changwon-si (KR); Nae Hyun Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 828 days.

(21) Appl. No.: 12/382,755

(22) Filed: Mar. 23, 2009

(65) Prior Publication Data

US 2010/0168923 A1 Jul. 1, 2010

(30) Foreign Application Priority Data

Dec. 26, 2008 (KR) ..... 10-2008-0134657

(51) Int. Cl.
*G05B 19/04* (2006.01)

(52) U.S. Cl. ..... 700/276; 250/342; 62/186

(58) Field of Classification Search ..... 700/276; 250/342; 62/186
See application file for complete search history.

(56) References Cited

U.S. PATENT DOCUMENTS

| | | | | | |
|---|---|---|---|---|---|
| 4,479,190 | A | * | 10/1984 | Takai et al. | 700/276 |
| 4,497,031 | A | * | 1/1985 | Froehling et al. | 700/276 |
| 5,103,391 | A | * | 4/1992 | Barrett | 700/4 |
| 5,163,399 | A | * | 11/1992 | Bolander et al. | 123/339.17 |
| 5,200,644 | A | * | 4/1993 | Kobayashi et al. | 307/66 |
| 5,331,825 | A | | 7/1994 | Kim | |
| 5,621,662 | A | * | 4/1997 | Humphries et al. | 700/276 |
| 5,870,994 | A | * | 2/1999 | Kato | 123/339.15 |
| 5,875,639 | A | | 3/1999 | Kim et al. | |
| 5,988,860 | A | * | 11/1999 | Hefferen et al. | 700/276 |
| 6,154,686 | A | * | 11/2000 | Hefferen et al. | 700/276 |
| 6,408,225 | B1 | * | 6/2002 | Ortmeier et al. | 700/254 |
| 6,549,826 | B1 | * | 4/2003 | Pouchak et al. | 700/276 |
| 6,735,968 | B2 | * | 5/2004 | Kurita et al. | 62/228.4 |
| 6,840,053 | B2 | * | 1/2005 | Lindner et al. | 62/140 |
| 6,870,139 | B2 | * | 3/2005 | Petrenko | 219/482 |
| 7,034,257 | B2 | * | 4/2006 | Petrenko | 219/482 |
| 7,706,928 | B1 | * | 4/2010 | Howell et al. | 700/295 |
| 7,734,381 | B2 | * | 6/2010 | Conger et al. | 700/301 |
| 2003/0182956 | A1 | * | 10/2003 | Kurita et al. | 62/228.1 |
| 2004/0146085 | A1 | * | 7/2004 | Lindner et al. | 374/109 |
| 2005/0204760 | A1 | * | 9/2005 | Kurita et al. | 62/228.1 |

(Continued)

FOREIGN PATENT DOCUMENTS

| | | |
|---|---|---|
| CN | 1079815 | 12/1993 |
| CN | 1115028 A | 1/1996 |

(Continued)

*Primary Examiner* — Mohammad Ali
*Assistant Examiner* — Anthony Whittington
(74) *Attorney, Agent, or Firm* — McKenna Long & Aldridge LLP

(57) ABSTRACT

The present invention relates to an air conditioner, including a temperature detection unit configured to detect an indoor temperature, a human body detection unit configured to rotatably operate and detect a person within an indoor area, a position determination unit configured to determine a position of the person based on data detected by the human body detection unit, and a control unit configured to perform an automatic operation for controlling a current of air according to the position of the person, determined by the position determination unit, if the indoor temperature reaches a first reference temperature according to an entry of an automatic operation mode and to perform a preparation operation for executing the automatic operation if the indoor temperature does not reach the first reference temperature, in the case where the automatic operation mode has been set.

13 Claims, 5 Drawing Sheets

(a)

(b)

U.S. PATENT DOCUMENTS

| | | | | |
|---|---|---|---|---|
| 2007/0103319 | A1* | 5/2007 | Pedraza et al. | 340/604 |
| 2009/0107160 | A1* | 4/2009 | Montminy et al. | 62/239 |
| 2009/0107657 | A1* | 4/2009 | Montminy et al. | 165/104.31 |
| 2009/0112368 | A1* | 4/2009 | Mann et al. | 700/275 |
| 2009/0230307 | A1* | 9/2009 | Han et al. | 250/342 |
| 2010/0060214 | A1* | 3/2010 | Woodward | 318/400.09 |
| 2010/0060215 | A1* | 3/2010 | Woodward | 318/400.09 |
| 2010/0060216 | A1* | 3/2010 | Woodward | 318/400.09 |
| 2010/0060218 | A1* | 3/2010 | Woodward | 318/400.15 |
| 2010/0060219 | A1* | 3/2010 | Schock et al. | 318/400.21 |

FOREIGN PATENT DOCUMENTS

| | | | |
|---|---|---|---|
| CN | 101294729 | A | 10/2008 |
| EP | 0589448 | | 3/1994 |
| EP | 1 460 351 | | 9/2004 |
| EP | 1985936 | A1 | 10/2008 |
| GB | 2 260 830 | | 4/1993 |
| JP | 05-240488 | | 9/1993 |
| WO | WO 2008/029679 | | 3/2008 |
| WO | WO 2008/066311 | A1 | 6/2008 |

* cited by examiner

AIR CONDITIONER AND METHOD OF OPERATING THE SAME

BACKGROUND OF THE INVENTION

1. Field of the Invention

The present invention relates to an air conditioner and a method of operating the same and, more particularly, to an air conditioner and a method of operating the same, which is capable of detecting the human body and automatically controlling a current of air in response to the position of the human body.

2. Discussion of the Related Art

An air conditioner is configured to control room temperature by discharging cooling or warm air into the interior of a room in order to make comfortable indoor environment and to provide more comfortable indoor environment to human beings by purifying indoor air. An air conditioner generally includes an indoor unit and an outdoor unit. The indoor unit is configured to include a heat exchanger and is placed indoors. The outdoor unit is configured to include a compressor, a heat exchanger, etc. and is configured to supply refrigerants to the indoor unit.

The air conditioner is controlled in the state where the indoor unit, including the heat exchanger, and the outdoor unit, including the compressor, the heat exchanger, etc., are separated from each other. The air conditioner is operated by controlling power applied to the compressor or the heat exchanger. Further, at least one indoor unit may be connected to the outdoor unit of the air conditioner, and the air conditioner operates in air cooling or heating mode by supplying the refrigerants to the indoor unit according to a requested operating state.

Wind direction control means for controlling the direction of the wind discharged into the interior of a room is included in the discharge port of this air conditioner. The direction of the wind can be changed by manipulating a wind direction setting button included in a remote controller, etc.

In the conventional air conditioner, the direction of the wind is adjusted through manual manipulation as described above. If a user is far from the air conditioner or frequently moves here and there, it is not easy to adjust the direction of the wind. Accordingly, a problem arises because it is difficult for a user feels comfortable.

In order to overcome the problem in controlling the direction of the wind, technology for controlling a current of air according to the position of a user within a room has recently been developed.

However, in controlling the direction of the wind according to the position of the human body, in the case where the human body is actually detected and an air current is supplied to the position of the human body, the air current does not reach the position of the human body depending on the indoor environment. Although the air current reaches the position of the human body, the air current reaches only a specific area. A problem arises because a user does not feel comfortable because the difference in the temperature between the specific area and surrounding indoor areas is increased.

Accordingly, there is a need for a method of more effectively providing a current of air when the air current is controlled based on a detected human body.

SUMMARY OF THE INVENTION

It is, therefore, an object of the present invention to provide an air conditioner and a method of operating the same, which is capable of increasing efficiency depending on an automatic operation based on a detected human body in such a manner that, in the case where the air conditioner detects the human body and automatically operates in such a way as to adjust the direction of an air current discharged in response to the position of the human body, the automatic operation is variably set depending on the distribution of indoor temperatures before the automatic operation starts and, if an indoor temperature satisfies a specific condition, an automatic operation depending on the position of the human body is performed.

An air conditioner according to an embodiment of the present invention includes a temperature detection unit configured to detect an indoor temperature, a human body detection unit configured to rotatably operate and detect a person within a room within an indoor area, a position determination unit configured to determine a position of the person based on data detected by the human body detection unit, and a control unit configured to perform an automatic operation for controlling a current of air according to the position of the person within the room, which has been determined by the position determination unit, if the indoor temperature reaches a first reference temperature according to an entry of an automatic operation mode and to perform a preparation operation for executing the automatic operation if the indoor temperature does not reach the first reference temperature, in the case where the automatic operation mode has been set.

If, during the automatic operation, the indoor temperature reaches or exceeds a second reference temperature set higher than the first reference temperature, the control unit stops the automatic operation and performs the preparation operation.

Further, when the preparation operation is performed, the control unit sets a direction of a wind so that up and down discharge angles of the wind are horizontal to the surface of land and the wind has full swing in left and right directions and controls the preparation operation so that the preparation operation operates by a maximum air volume.

The control unit compares the indoor temperature and each of a first reference temperature and a second reference temperature which have been set according to a desired temperature and are fetched from a previously stored reference temperature table, wherein the first reference temperature is a temperature value which is a criterion for switching the preparation operation to the automatic operation, and the second reference temperature is a temperature value which is a criterion for switching the automatic operation to the preparation operation.

If at least one of termination conditions, including that the automatic operation mode is set in operation modes other than an air cooling mode, a supplementary function is set in the automatic operation mode, a sleep operation is set, and a direction of a wind or a volume of air is changed, is satisfied, the control unit terminates the automatic operation mode.

A method of operating an air conditioner according to an embodiment of the present invention includes the steps of, when an automatic operation mode is set, performing a preparation operation, if, during the preparation operation, an indoor temperature reaches a first reference temperature for entering an automatic operation according to a desired temperature, stopping the preparation operation and performing the automatic operation, while the automatic operation is performed, detecting a person within an indoor area and calculating a position of the person, and changing a direction of a wind or a volume of air and providing a current of air according to the position of the person within the room.

The method further includes the step of, if, before the step of performing the preparation operation, the indoor temperature is equal to or lower than the first reference temperature, performing the automatic operation without performing the preparation operation.

The preparation operation is performed by a maximum air volume and through full swing according to the desired temperature.

The method further includes the step of, in the step of calculating the position or the step of providing the current of air, if the indoor temperature is equal to or higher than a second reference temperature which is a reference value for switching to the preparation operation and is set to be higher than the first reference temperature, stopping the automatic operation and performing the preparation operation.

The step of providing the current of air comprises controlling the current of air so that the current of air reaches an area corresponding to the position of the person within the room when direct wind is set and the current of air reaches neighbor areas on the basis of the position of the person within the room when indirect wind is set.

The method further includes the step of, when the automatic operation mode is set, if at least one of termination conditions, including that the automatic operation mode is set in operation modes other than an air cooling mode, a supplementary function is set in the automatic operation mode, a sleep operation is set, and a direction of a wind or a volume of air is changed, is satisfied, terminating the automatic operation mode and performing an ordinary operation.

If the person within the room is not detected in the indoor area while the step of calculating the position or the step of providing the current of air is performed, a last operating state according to the automatic operation is maintained unless the automatic operation mode is terminated by any one of the termination conditions.

In accordance with the air conditioner and the method of operating the same according to the present invention, in the case where an automatic operation for adjusting the direction of an air current discharged based on a detected human body is performed, if a condition according to the distribution of indoor temperatures or an input setting is satisfied, an automatic operation is performed. An automatic operation based on a detected human body can be prevented from being unnecessarily performed, and a current of air can be efficiently adjusted through the detected human body. Accordingly, there are advantages in that a current of air may be effectively adjusted, comfortable environment may be provided to users, and a user may feel a sense of satisfaction for products.

Moreover, according to the present invention, the human body is detected, and a preparation operation based on a detected indoor temperature or an automatic operation based on the detected human body is performed. Accordingly, an operation can be set or changed depending on a user setting. If sensors are out of order, an automatic operation is terminated and an ordinary operation is performed, rather than providing a current of air based on an erroneous detection of the human body. Accordingly, a more comfortable indoor environment can be provided.

BRIEF DESCRIPTION OF THE DRAWINGS

The above and other objects and features of the present invention will become apparent from the following description of some embodiments given in conjunction with the accompanying drawings, in which.

DETAILED DESCRIPTION OF THE EMBODIMENTS

Hereinafter, embodiments of the present invention will be described in detail with reference to the accompanying drawings.

Figure 1:
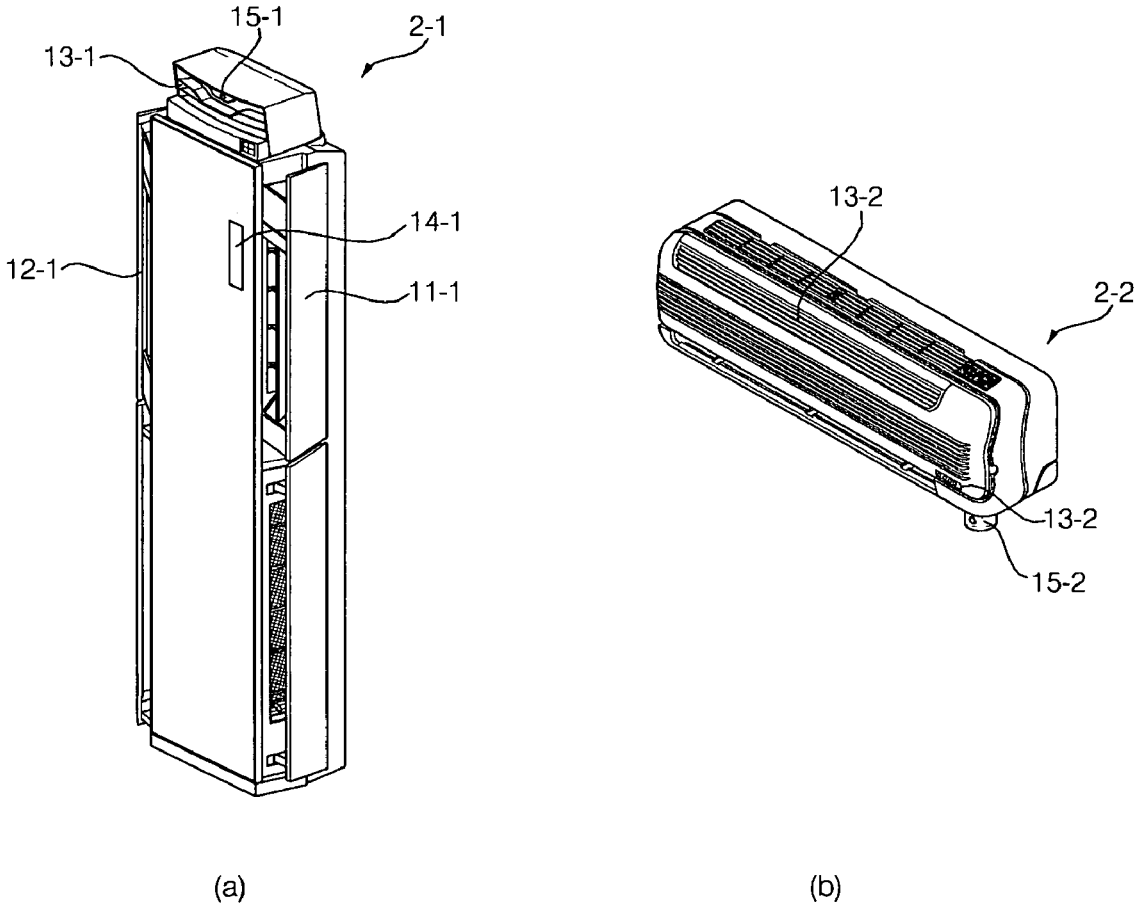
FIG. 1 is a perspective view showing an air conditioner according to an embodiment of the present invention.

FIG. 1 is a perspective view showing an air conditioner according to an embodiment of the present invention. FIG. 1(*a*) shows an example of a stand type indoor unit, and FIG. 1(*b*) shows an example of a wall-mount indoor unit. The air conditioner according to an embodiment of the present invention may be applied to any air conditioners, such as a stand air conditioner, a wall-mount air conditioner, and a ceiling type air conditioner.

The air conditioner of the present invention includes an indoor unit 2-1 and an outdoor unit (not shown). The indoor unit 2-1 and the outdoor unit are coupled to each other via a refrigerant pipe.

The outdoor unit includes a compressor, an outdoor heat exchanger, and so on. The outdoor unit compresses or performs heat exchange between the refrigerants and supplies the refrigerants to the indoor unit according to an operating state of the air conditioner. The outdoor unit is driven at the request of the indoor unit and is configured to have a varying cooling/heating capacity according to the driven indoor unit. Accordingly, the number of outdoor units driven and the number of compressors driven, included in the outdoor unit, are changed depending on the varying cooling/heating capacity.

The outdoor unit includes the compressor for compressing the refrigerants supplied thereto, the outdoor heat exchanger for performing heat exchange between the refrigerants and an outdoor air, an outdoor fan, an accumulator for extracting gaseous refrigerants from the refrigerants and supplying the extracted refrigerants to the compressor, and a 4-way valve for selecting the flow of the refrigerants according to a heating operation. The outdoor unit further includes a pressure sensor configured to detect the pressure of the refrigerants discharged from the compressor and the pressure of the refrigerants supplied to the compressor and a temperature sensor connected to a refrigerant pipe and configured to detect the temperature of the refrigerants. The outdoor unit further includes a number of sensors, valves, an oil collector, etc., but descriptions thereof are omitted.

The indoor unit includes an indoor heat exchanger, an indoor unit fan, an expansion valve for expanding the refrigerants supplied from the outdoor unit, and a number of sensors.

One indoor unit may be connected to one outdoor unit or a plurality of indoor units may be connected to one outdoor unit according to circumstances. One or more indoor units may be placed within a room.

The outdoor unit and the indoor unit constructed as above are connected to each other via the refrigerant pipe, and they are configured to perform an air cooling or heating operation according to the flow of the refrigerants and to exchange data using a communication method.

Referring to FIG. 1(*a*), the indoor unit 2-1 includes a human body detection unit 15-1. The human body detection unit 15-1 is configured to separate the human body and human body mistake factors from among heat sources based on radiation signals for the radiation heats of the heat sources and outputs a human body detection signal.

The indoor unit 2-1 further includes a left discharge port 12-1, a right discharge port 11-1, and an upper discharge port 13-1 for discharging an air current into the interior of a room. An indoor fan for sucking in an indoor air and generating ventilation power so that the sucked-in air is discharged outside and an indoor heat exchanger for performing heat exchange between the air, blown by the indoor fan, and the refrigerants are included within the indoor unit 2-1. The indoor unit 2-1 further includes a channel along which air is sucked in through air intake ports formed on the lower side of the indoor unit 2-1, air-conditioned within the indoor unit 2-1, and then discharged through at least one of the left discharge port 12-1, the right discharge port 11-1, and the upper discharge port 13-1.

Here, vanes are formed to open or shut the air intake ports and at least one of the left discharge port 12-1, the right discharge port 11-1, and the upper discharge port 13-1 and to provide guidance to air. The vanes function to open or shut the respective air intake ports and the respective discharge ports and to also provide guidance to the direction of an intake air and a discharge air.

The indoor unit 2-1 further includes a display unit 14-1 for displaying an operating state and setting information of the indoor unit and an input unit (not shown) for inputting set data.

It is illustrated that the display unit 14-1 is placed in the front panel of the indoor unit 2-1. However, the display unit 14-1 may be placed under the discharge port 13-1, and the position of the display unit 14-1 may vary depending on the design. Further, the input unit may include entry means, such as at least one button or switch, a touch pad, or a touch screen, and receive data.

It is illustrated that the upper discharge port 13-1 of the indoor unit 2-1 is driven up and down, but not limited thereto. In the case where the human body detection unit 15-1 is placed in the upper discharge port 13-1 as shown in FIG. 1(*a*), the upper discharge port 13-1 may be placed or constructed in such a way as to detect the human body when the indoor unit 2-1 operates.

It is illustrated that the human body detection unit 15-1 is placed in the upper discharge port 13-1 of the indoor unit, but the position of the human body detection unit 15-1 may vary depending on the design. For example, the human body detection unit 15-1 may be placed on the upper portion of the upper discharge port 13-1 or may be projected from the top of the indoor unit and may rotatably operate.

The human body detection unit 15-1 is configured to rotatably operate and detect a person within a room by scanning the room within a predetermined range. Here, the human body detection unit 15-1 may include at least one of an infrared sensor, an ultrasonic sensor, and a camera. The number of sensors may be one or more. For example, the human body detection unit 15-1 may include a plurality of infrared sensors arranged in parallel and configured to detect the radiation heat of the human body.

The human body detection unit 15-1 rotates within the indoor area and detects a person within a room by detecting the radiation heat of a heat source using sensors included therein.

The human body detection unit 15-1 scans the indoor area while rotating in a first rotation direction and a second rotation direction, accumulates and stores scanned data, and detects the human body based on the accumulated stored data.

The indoor unit 2-1 performs a preparation operation before an automatic operation is performed based on the detection of the human body using the human body detection unit 15-1 so that, when a current of air is controlled based on the detection of the human body, a smooth and effective operation can be performed.

The indoor unit 2-1 determines whether to start the automatic operation based on the detection of the human body in response to input data or detected indoor environment or both. If a condition is not satisfied, the indoor unit terminates the automatic operation based on the detection of the human body.

Referring to FIG. 1(*b*), an indoor unit 2-2 includes a human body detection unit 15-2 placed at the bottom of the main body and configured to rotatably operate.

A description of the remaining construction of the indoor unit 2-2 is the same as that given with reference to the indoor unit 2-1. Here, the shape of discharge ports and the structure of vanes or louvers, and a method of controlling the same differ depending on the types of indoor units, but the indoor units in common include an air intake port, discharge ports, a heat exchanger, and an indoor fan.

The human body detection unit 15-2 may be placed within the main body of the indoor unit 2-2. In this case, when the indoor unit performs an automatic operation based on the detection of the human body, the human body detection unit 15-2 may drop and rotate on the lower side of the main body of the indoor unit 2-2, thereby scanning an indoor area. Here, the human body detection unit 15-2 may, as described above, include at least one infrared sensor and detects a person within a room through the sensor.

Here, the human body detection unit 15-2 may rotate 180° and scan the interior of a room or may rotate 360° and scan the interior of a room according to circumstances. The human body detection unit 15-2 may preferably rotate 270° and perform a rotation operation with consideration taken of that the indoor unit is placed on a wall.

The human body detection unit may be placed in the main body of the indoor unit, as shown in FIG. 1(*a*) or (*b*), and the range of a detection area may vary depending on the position and shape of the human body detection unit. It is to be noted that the above examples are only illustrative, and any position or structure or both which is capable of detecting the human body by scanning the indoor area may be applied to the human body detection unit.

Figure 2:
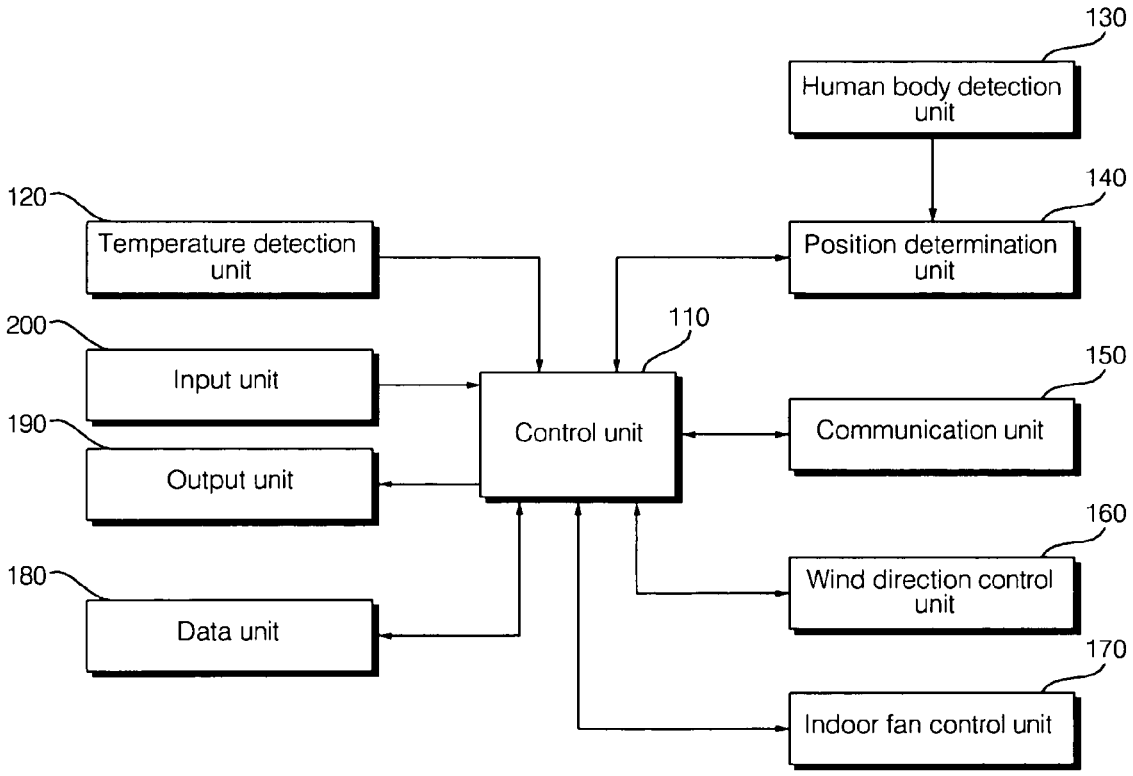
FIG. 2 is a block diagram showing the construction of an indoor unit according to an embodiment of the present invention.

FIG. 2 is a block diagram showing the construction of the indoor unit according to an embodiment of the present invention.

Referring to FIG. 2, the main body of the indoor unit is constructed as described above and is configured to include a temperature detection unit 120, an input unit 200, an output unit 190, a data unit 180, a human body detection unit 130, a position determination unit 140, a communication unit 150, a wind direction control unit 160, an indoor fan control unit 170, and a control unit 110 for controlling the entire operation of the indoor unit.

The wind direction control unit 160 and the indoor fan control unit 170 are connected to a motor. The main body controls wind direction control means, included in the respective discharge ports, and also controls the indoor fan so that the indoor fan performs a rotation operation.

The temperature detection unit 120 includes a plurality of temperature sensors. The temperature detection unit 120 detects a temperature of air sucked in to the indoor unit, a temperature of air discharged indoors, a pipe temperature of the refrigerants sucked in to the indoor heat exchanger, and a pipe temperature of the refrigerants discharged from the indoor heat exchanger and transmits the detected temperatures to the control unit 110.

Here, the temperature detection unit 120 may measure an indoor temperature by detecting a blown temperature for the temperature of air discharged indoors and detecting a temperature sucked in indoors. The indoor temperature may be measured by a local controller and then input through the communication unit 150, according to circumstances.

The temperature detection unit 120 may also be placed outside the indoor unit. In this case, temperature values detected using a wired or wireless method may be received through the communication unit 150 and then applied to the control unit 110.

The input unit 200 receives setting data, such as operation setting or operation mode of the air conditioner, and applies the received setting data to the control unit 110. The input unit 200 may include at least one switch or button, a touch key, a touch pad, or a touch screen and may receive data through the manipulation of the button or touch.

The output unit 190 outputs the menu screen of the indoor unit and outputs data, input through the input unit 200, and data transmitted or received through the communication unit 150. Further, when the air conditioner operates according to a control command of the control unit 110, the output unit 190 outputs an operating state, etc. of the air conditioner. The output unit 190 may be placed on the front side of the main body of the indoor unit, as shown in FIG. 1(*a*), or may be placed on the top of the front panel or on the lower side of the upper discharge port according to circumstances.

The output unit 190 includes display means for outputting text and images. The output unit 190 may further include sound output means for outputting specific sound, such as effect sound, alarm, and voice guidance, and a lamp configured to turn on or off or to output operation information according to emission color.

The communication unit 150 exchanges data with the outdoor unit, or other indoor units or other local controllers using a wired or wireless communication method.

The communication unit 150 may use not only wired communication using wired cables, power line communication, and wired communication methods, such as a wired LAN, but also short distance wireless communication methods, such as infrared rays, Bluetooth, RF communication, and Zigbee communication or wireless communication methods, such as a wireless LAN, WiBro, and high-speed mobile communication.

The data unit 180 stores data, such as control data used to operate the air conditioner, screen configuration data output through the output unit 190, and effect sound data. The data unit 180 further stores position detection data, used by the position determination unit 140 in order to analyze signals detected by the human body detection unit 130, and data used to set an operation according to an indoor area scanned by the position determination unit 140, an indoor temperature, a setting mode, or a required load.

In particular, the data unit 180 stores reference data which is used by the control unit 110 in order to determine whether to perform an automatic operation based on a detected position.

The human body detection unit 130 is placed on the top or lower side of the main body of the indoor unit as described above with reference to FIG. 1 and is configured to rotatably operate and detect a person within a room while scanning the indoor area. Here, the human body detection unit 130 may detect the human body using infrared rays or may detect the human body using the radiation heat of the human body.

The human body detection unit 130 includes at least one sensor for detecting the human body, a rotation unit for rotating the sensor, and so on.

The human body detection unit 130 may include at least one detection means, such as an infrared sensor, an ultrasonic sensor, and a camera. The number of detection means may be one or more. For example, the human body detection unit 130 may include detection means in which a plurality of infrared sensors is arranged in parallel and is configured to detect the radiation heat of the human body for respective different areas.

The human body detection unit 130 is configured to rotatably operate according to a control command of the control unit 110 and to scan the indoor area while rotating in a first rotation direction or a second rotation direction. The human body detection unit 130 may divide and scan the indoor area according to a short distance and a long distance and may divide and scan the left, right, and central portions.

The position determination unit 140 detects the human body based on signals input through the human body detection unit 130. Here, the position determination unit 140 detects the human body and determines the position of the human body based on previously stored position detection data and reference data for determination.

If the indoor area is scanned several times by the human body detection unit 130, the position determination unit 140 accumulates and stores the scanned data in the data unit 180, and detects the human body and determines the position of the human body according to the number of detected frequency based on the accumulated data. The position determination unit 140 transmits the determination results to the control unit 110.

The control unit 110 sets an operation mode and the direction of the wind on the basis of the determination result data, received from the position determination unit 140, and applies a control command for controlling a current of air to the wind direction control unit 160.

Here, in the case where an automatic operation mode based on the detection of the human body has been set, the control unit 110 controls the human body detection unit 130 and the position determination unit 140 so that they perform a preparation operation before the automatic operation based on the detection of the human body is performed. If, as a result of the preparation operation, an indoor environment is determined to satisfy a certain condition, the control unit 110 operates the human body detection unit 130.

In the case where an automatic operation mode has been set through the input unit 200 or data according to the setting of the automatic operation mode is received from a local controller through the communication unit 150, the control unit 110 determines a reference temperature based on a desired temperature, determines whether a current indoor temperature detected by the temperature detection unit 120 satisfies the reference temperature, and performs an automatic operation based on the detection of the human body or a preparation operation.

Here, the control unit checks a reference temperature, set based on a desired temperature, with reference to a reference temperature table stored in the data unit 180. The control unit 110 compares an indoor temperature with each of a first reference temperature and a second reference temperature, set based on a desired temperature fetched from a previously stored reference temperature table. The first reference temperature is a temperature value (i.e., a criterion for switching the operation of the air conditioner from the preparation operation to the automatic operation), and the second reference temperature is a temperature value (i.e., a criterion for switching the operation of the air conditioner from the automatic operation back to the preparation operation).

If, as a result of the comparison, the detected indoor temperature is determined not to satisfy the first reference temperature set based on the desired temperature, the control unit 110 does not perform the automatic operation, but performs the preparation operation. If, as a result of the comparison, the detected indoor temperature is determined to satisfy the first reference temperature, the control unit 110 immediately performs the automatic operation. Further, if, as a result of the comparison, the detected indoor temperature does not satisfy the second reference temperature set based on the desired temperature, the control unit 110 stops the automatic operation based on the detection of the human body and performs the preparation operation.

When the preparation operation is performed, the control unit 110 opens all the discharge ports, sets full swing, and applies a control command to the wind direction control unit 160 so that a current of air can reach the entire room irrespective of the detected human body, and applies a control command to the indoor fan control unit 170 so that the volume of air becomes a maximum.

Further, if an indoor temperature does not reach the first reference temperature even though the preparation operation has been performed for a specific period of time, the control unit 110 immediately performs the automatic operation.

While the preparation operation is performed as described above, the control unit 110 compares a temperature value, received from the temperature detection unit 120, with each of the first reference temperature and the second reference temperature which are set based on the desired temperature. If, as a result of the comparison, the temperature value is determined to have reached the reference temperature, the control unit 110 performs the automatic operation so that the direction of the wind or the volume of air or both is changed according to a detected human body.

Further, if, after the automatic operation mode has been set, a supplementary function is set or a specific operation mode is set, the control unit 110 terminates the automatic operation mode.

If an automatic operation mode termination request is received or a condition for terminating the automatic operation mode is satisfied while the automatic operation is being executed or the preparation operation is being executed in order to perform the automatic operation, the control unit 110 terminates the automatic operation mode and performs an ordinary operation.

For example, if an operation mode, such as a heating mode, a dehumidification mode, an artificial intelligence mode, an air cleaning mode, a ventilation mode, or a heater mode, is set or if a supplementary function, such as a power saving operation, a long power operation, or a turbo operation, is set, the control unit 110 terminates the automatic operation mode based on the detection of the human body. Further, although a setting for the automatic operation mode based on the detection of the human body is input if a sleep operation has been set or while a sleep operation is being executed, the control unit 110 disregards the input and maintains the sleep operation. In this case, the control unit 110 may output a guidance message, indicating that the automatic operation mode may not be set, through the output unit 190.

Further, if, while the automatic operation mode based on the detection of the human body is being executed, the above-described operation mode or the above-described supplementary function is set or if the direction of the wind or the volume of air is changed, the control unit 110 terminates the automatic operation mode.

Here, if, while the air conditioner operates in a specific operation mode or according to a specific setting, the automatic operation mode is set, the control unit 110 performs the automatic operation according to a desired temperature for the automatic operation in response to a previously set desired temperature and then maintains the set desired temperature even after the automatic operation mode is terminated.

If, after the control unit 110 has switched to the automatic operation mode, the control unit 110 is operated in a mode in which the automatic operation mode is terminated as described above, however, the control unit 110 disregards pertinent settings and performs the automatic operation. Even after the automatic operation mode is terminated, the control unit 110 does not return to the previous setting and performs the air cooling operation based on the same desired temperature.

The wind direction control unit 160 controls the opening or closing of the left discharge port, the right discharge port, and the upper discharge port in response to a control command from the control unit 110 and controls the directions of discharge ports.

The indoor fan control unit 170 operates the motor in response to a control command of the control unit 110, thus driving the indoor fan and controlling the number of rotations.

If the air conditioner operates in the automatic operation mode, the wind direction control unit 160 controls each of the discharge ports in response to a control command of the control unit 110 depending on human body detection results so that a current of air reaches a designated position. The indoor fan control unit 170 rotates the indoor fan based on a set rotational frequency depending on the automatic operation mode in response to a control command of the control unit 110. Here, the wind direction control unit 160 drives the motor so that wind direction control means, included in each of the discharge ports, moves or rotates, thereby controlling the direction of the wind at a set discharge angle.

Meanwhile, if the automatic operation mode is terminated, the wind direction control unit 160 and the indoor fan control unit 170 control the direction of the wind and control the intensity of the wind based on an input operation setting.

Here, if the operating state of the air conditioner is changed, the control unit 110 controls the output unit 190 so that the output unit 190 outputs the changed operation information in the form of at least one of text, images, sound, and a warning flare so that a user can recognize the changed operation information. In particular, if the automatic operation mode is set and executed or the automatic operation mode is terminated, the control unit 110 controls the output unit 190 so that the output unit 190 outputs at least one of an alarm, a warning flare, and a warning message.

Meanwhile, if the human body is not detected during the automatic operation, the control unit 110 does not change the last operating state depending on the automatic operation unless the automatic operation mode is terminated according to the above-described condition.

An operation of the present invention as described above is described below with reference to the drawings.

Figure 3:
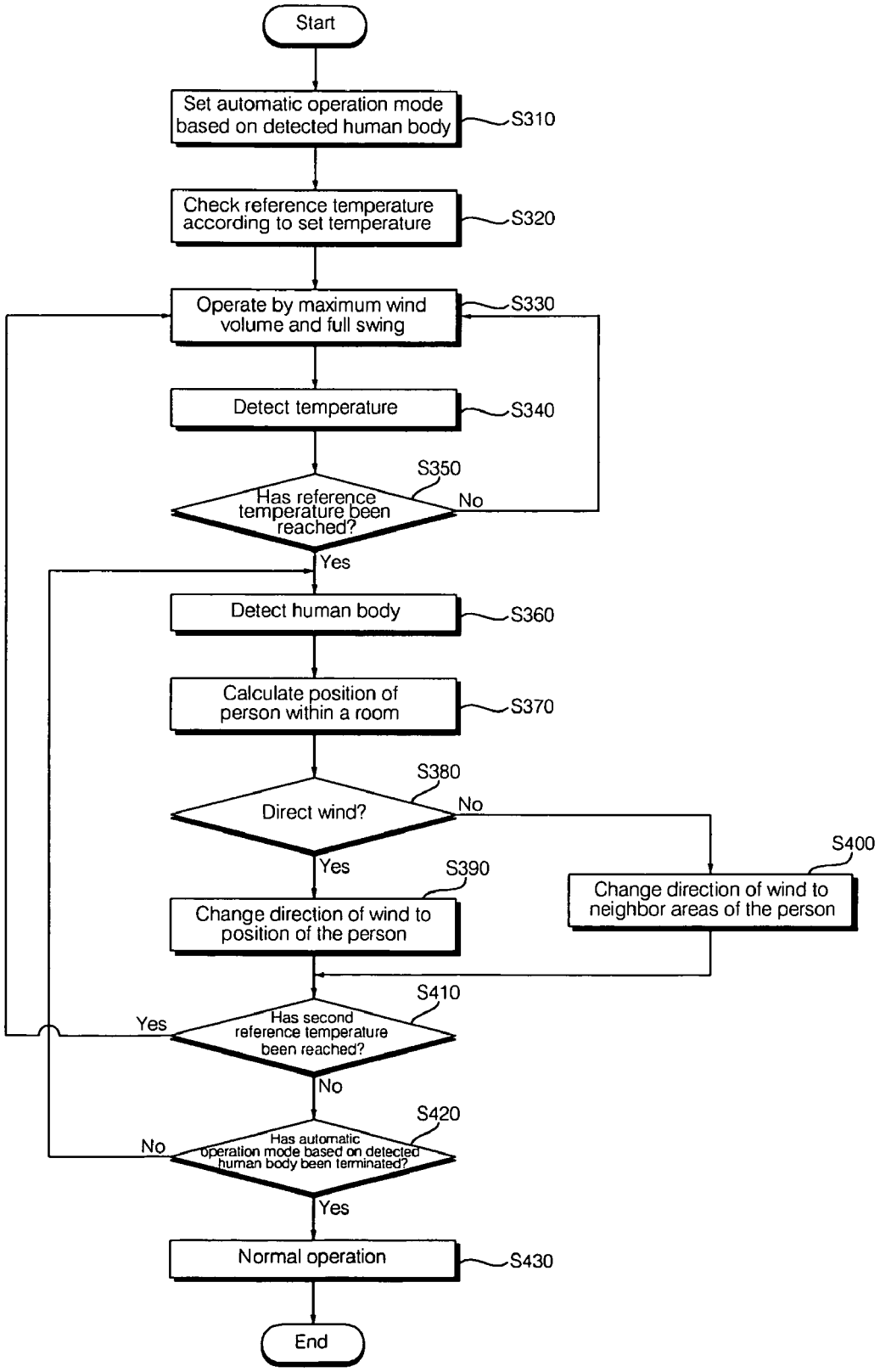
FIG. 3 is a flowchart showing an automatic operation method based on a detected human body, executed by the air conditioner, according to an embodiment of the present invention.

FIG. 3 is a flowchart showing an automatic operation method based on the detection of the human body, executed by the air conditioner, according to an embodiment of the present invention.

Referring to FIG. 3, when the automatic operation mode based on the detection of the human body is set through the input unit 200 or the communication unit 150 at step S310, the control unit 110 checks a first reference temperature and a second reference temperature based on a set temperature (i.e., a desired temperature) at step S320.

The control unit 110 sets the volume of air to a maximum air volume and the direction of the wind to full swing so that the preparation operation is performed. Here, the control unit 110 applies a control command to each of the wind direction control unit 160 and the indoor fan control unit 170 so that the maximum air volume and the full swing operation are performed at step S330.

In this case, the wind direction control unit 160 controls the right/left and up/down directions of the wind in response to a control command of the control unit 110 according to full swing. For example, the wind direction control unit 160 may control the left and right directions of the wind in the range of −45 to 45° on the basis of the front side of the indoor unit and may control the direction of the wind by setting the up and down directions of the wind so that the up and down directions are parallel to the surface of land.

Further, the indoor fan control unit 170 drives the motor in response to the setting of the maximum air volume so that the indoor fan rotatably operates at a maximum rotational frequency.

The control unit 110 controls the temperature detection unit 120 so that the temperature detection unit 120 detects an indoor temperature at step S340 and determines whether the detected indoor temperature has reached a first reference temperature set according to a desired temperature at step S350. If, as a result of the determination, the detected indoor temperature is determined not to have reached the first reference temperature, the control unit 110 performs a preparation operation through a maximum air volume and full swing as described above.

Here, the indoor temperature may be measured based on the temperature of an intake air sucked in through the indoor unit. Alternatively, the indoor temperature may be measured using an additional indoor temperature sensor or using a temperature value received through a local controller.

The control unit 110 may detect a temperature and compare the detected indoor temperature with the reference temperature before the preparation operation is performed. If the detected indoor temperature is lower than the first reference temperature, the control unit 110 immediately performs the automatic operation without an additional preparation operation.

If the indoor temperature is equal to or lower than the first reference temperature while the air cooling operation is being performed, the control unit 110 determines that the reference temperature has been satisfied. Here, the first reference temperature is a reference value for switching the preparation operation to the automatic operation according to a desired temperature and may be changed according to the desired temperature.

The first or second reference temperature is set to be higher than the desired temperature on the grounds that, although the air conditioner operates according to the desired temperature, the indoor temperature is not uniformly distributed during air cooling. If the air conditioner is operated according to the desired temperature, the first or second reference temperature may be set to an average value or more of indoor temperatures.

Meanwhile, the second reference temperature for starting the preparation operation again after the automatic operation was stopped may be set to be 1.5 to 3° C. higher than the first reference temperature. The higher the desired temperature, the greater the difference between the second reference temperature and the first reference temperature.

The first reference temperature and the second reference temperature are stored in the data unit 180 as reference temperature data.

For example, when the desired temperature is less than 18 to 25° C., the first reference temperature may be set to 26.5° C. and the second reference temperature may be set to 28° C. When the desired temperature is more than 25° C. to less than 27° C., the reference temperature may be set to 27.5° C. and the second reference temperature may be set to 29° C. When the desired temperature is 29° C. or more, the reference temperature may be set to 30° C. and the second reference temperature may be set to 33° C.

The above-described reference temperature may vary depending on an average temperature of indoor space or the distribution of temperatures. The reference temperature may also vary depending on the capacity of an air conditioner.

Meanwhile, if, as a result of the determination at step S350, the indoor temperature has reached the first reference temperature, the control unit 110 stops the preparation operation and performs the automatic operation. Accordingly, the control unit 110 controls the human body detection unit 130 so that the human body detection unit 130 scans the indoor space. The human body detection unit 130 detects the human body within the indoor space based on the radiation heat of the human body while rotating at step S360. Alternatively, the human body may be detected during the preparation operation.

Here, the human body detection unit 130 periodically inputs detection data for the human body to the position determination unit 140 and repeatedly detects the human body within the indoor area several times.

The position determination unit 140 accumulates and stores the data periodically received from the human body detection unit 130. If the accumulated data exceeds a predetermined number, the position determination unit 140 calculates the position of a person within a room according to the frequency number of the detected human body at step S370.

In the case where a current of air is supplied to the calculated position of a person within the room, the control unit 110 determines whether direct wind has been set at step S380. If, as a result of the determination, the direct wind is determined to have been set, the control unit 110 changes the direction of the wind to the calculated position of the person within the room so that a current of air reaches the person within the room at step S390. If, as a result of the determination at step S390, the direct wind is determined not to have been set, but, for example, indirect wind is determined to have been set, the control unit 110 changes the direction of the wind to surrounding areas on the basis of the calculated position of the person within the room so that a current of air indirectly reaches the person within the room at step S400.

Here, the direction of the wind or the volume of air during the automatic operation is automatically set according to the position of the person within the room. For example, when the person within the room is placed on the left side at a short distance, the control unit 110 may control the direction of the wind by controlling the up and down directions of the wind and the opening or closing of each of the left and right discharge ports and also controlling a discharge angle of each of the left and right discharge ports according to the position when direct wind is set, so a current of air reaches the position of the person within the room. Further, in the case where a person within the room is placed in a central area at a long distance, the control unit 110 may control the direction of the wind by upward controlling the discharge angle of the upper discharge port so that a current of air reaches a long distance and may open only the upper discharge port or both the left and right discharge ports, but control the discharge angle of the upper discharge port or each of the left and right discharge ports toward a central area.

Here, in the case where, during the automatic operation based on the detection of the human body as described above, an indoor temperature detected by the temperature detection unit 120 reaches the second reference temperature (i.e., in the case where a temperature sucked in into the indoor unit reaches or is higher than the second reference temperature while a current of air is being supplied on the basis of the person within the room through direct wind or indirect wind), the control unit 110 stops the automatic operation based on the detection of the human body at step S410 and performs the preparation operation at step S330.

In other words, in the case where, while a current of air depending on the position of the person within the room is being controlled, the temperature of the indoor area entirely raises, the control unit 110 decreases the indoor temperature through the full swing operation of a maximum air volume. If the indoor temperature satisfies the reference temperature, the control unit 110 performs the automatic operation based on the detection of the human body again at steps S330 to S410.

Next, the control unit 110 determines whether, when the indoor temperature keeps lower than the second reference temperature through the automatic operation based on the detection of the human body, the termination of the automatic operation mode based on the detection of the human body has been set or requested at step S420. If, as a result of the determination, the termination of the automatic operation mode based on the detection of the human body is determined to have been set or requested, the control unit 110 terminates the automatic operation mode and switches to an ordinary operation mode at step S430.

In this case, the control unit 110 performs an ordinary air cooling operation while maintaining the desired temperature during the automatic operation.

If, as a result of the determination at step S430, the termination of the automatic operation mode based on the detection of the human body is determined not to have been set or requested, the control unit 110 periodically detects the human body as described above and supplies a current of air toward the person within the room through direct wind or indirect wind based on the detection of the human body at steps S360 to S420.

As described above, according to the present invention, the preparation operation and the automatic operation are performed depending on a change in the indoor temperature when a current of air is controlled toward a specific area through the detection of the human body. Accordingly, an average distribution of temperatures within an indoor area can become uniform through the preparation operation. Consequently, when a current of air is supplied to a specific area for the position of a person within a room, the person may feel more comfortable, and a current of air can be controlled more efficiently.

Figure 4:
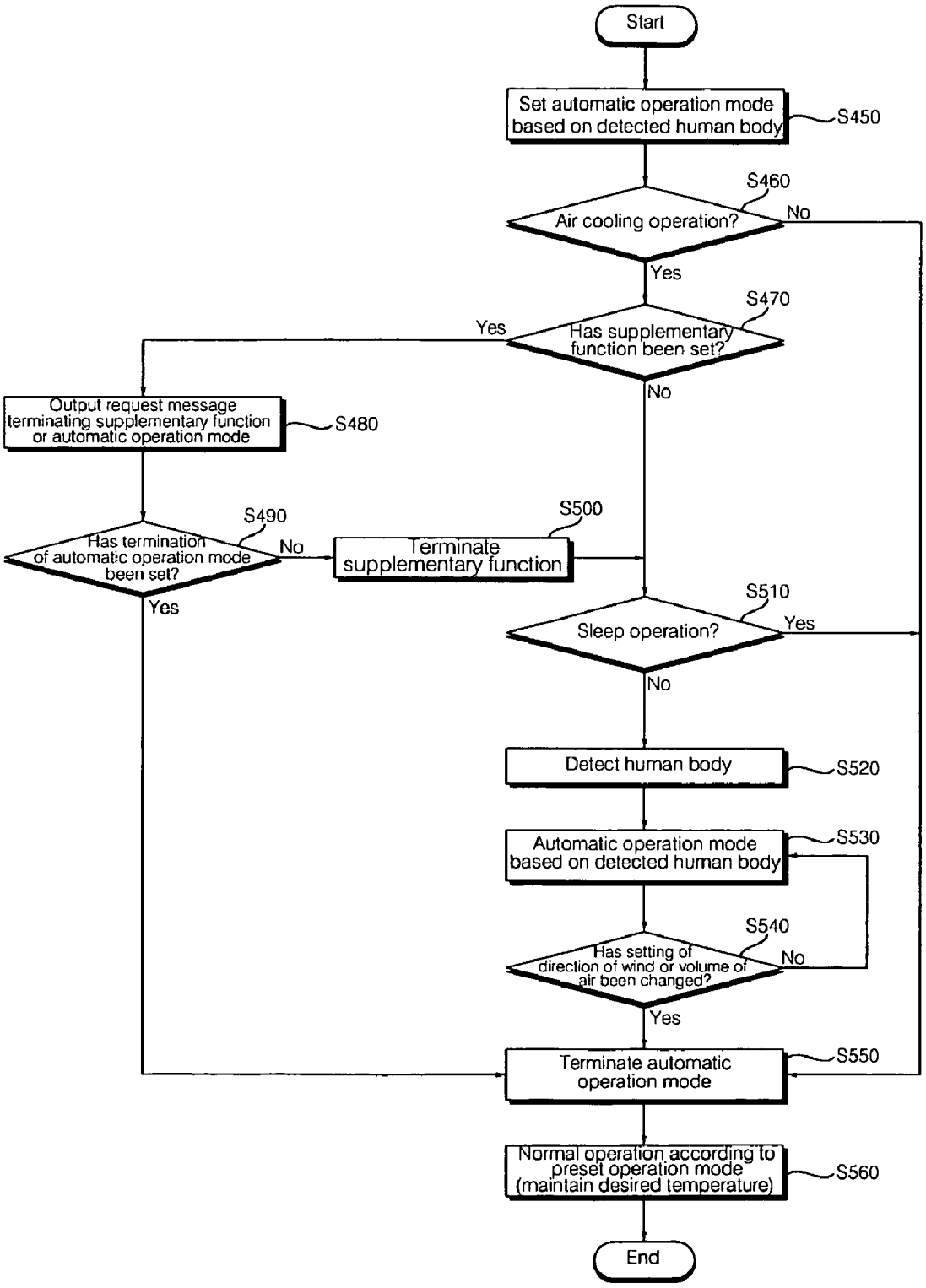
FIG. 4 is a flowchart showing a method of terminating an automatic operation of the air conditioner according to an embodiment of the present invention.

FIG. 4 is a flowchart showing a method of terminating an automatic operation of the air conditioner according to an embodiment of the present invention.

Referring to FIG. 4, the air conditioner terminates the automatic operation mode if a specific setting is input or a condition is not satisfied while the automatic operation based on the detection of the human body is being performed.

The automatic operation mode based on the detection of the human body is set at step S450. When the automatic operation mode is set as shown in FIG. 3 and the indoor unit performs the preparation operation or the automatic operation, the control unit 110 determines whether the set automatic operation mode is an air cooling operation at step S460. If, as a result of the determination, the set automatic operation mode is determined not to be the air cooling operation, the control unit 110 terminates the automatic operation mode at step S550.

Next, the control unit 110 disregards the setting of the automatic operation mode and performs an ordinary operation according to a preset operation mode at step S560. At this time, a desired temperature keeps intact.

Meanwhile, if, as a result of the determination at S460, the set automatic operation mode is determined to be the air cooling operation, the control unit 110 executes the automatic operation mode and determines whether a supplementary function has been set at step S470. If, as a result of the determination, the supplementary function is determined to have been set, the control unit 110 terminates the supplementary function or outputs a request message indicative of the termination of the automatic operation mode at step S480. If any one mode is not terminated for a specific period of time, the control unit 110 terminates the automatic operation mode.

The control unit 110 determines whether the automatic operation mode has been set to be terminated in response to the request message at step S490 or whether the automatic operation mode has been automatically set to be terminated. If, as a result of the determination, the automatic operation mode has been set to be terminated, the control unit 110 terminates the set automatic operation mode at step S550 and then performs an ordinary operation according to a preset operation mode at step S560. At this time, a desired temperature keeps intact.

However, if, as a result of the determination at step S490, the automatic operation mode is determined not to be terminated and the supplementary function is set to be terminated, the control unit 110 terminates the supplementary function at step S500 and executes the automatic operation mode.

If the supplementary function has not been set in the state where the automatic operation mode is set, or a sleep operation is set although the supplementary function has been terminated as described above at step S510, the control unit 110 terminates the set automatic operation mode at step S550 and performs an ordinary operation according to a preset operation mode at step S560. At this time, a desired temperature keeps remains.

However, if the automatic operation mode has been set in the air cooling operation, an additional supplementary function has not been selected, and the operation mode is not the sleep operation, the control unit 110 executes the automatic operation mode. In this case, if an indoor temperature has not reached a first reference temperature as in FIG. 3, the control unit 110 stops the automatic operation and executes the preparation operation. If the indoor temperature reaches the first reference temperature, the control unit 110 detects the human body at step S520 and performs the automatic operation according to the position of the person within the room based on the detection of the human body at step S530. Here, the direction of the wind or the volume of air or both during the automatic operation is automatically set according to the position of the person within the room.

If a setting for the direction of the wind or the volume of air (the intensity of the wind) changes during the automatic operation as described above, the control unit 110 terminates the automatic operation mode at step S550 and performs an ordinary operation according to a preset operation mode at step S560.

According to the present invention, if the detection of the human body is difficult as described above although the automatic operation mode has been set, the efficiency of the air conditioner is low because there is almost no movement in the human body, or a specific function is set or changed, such as that a setting is changed by a user, the automatic operation mode based on the detection of the human body is terminated and an ordinary operation is executed. Accordingly, a user's requirements can be accommodated and the detection of the human body can be prevented from being unnecessarily performed.

Figure 5:
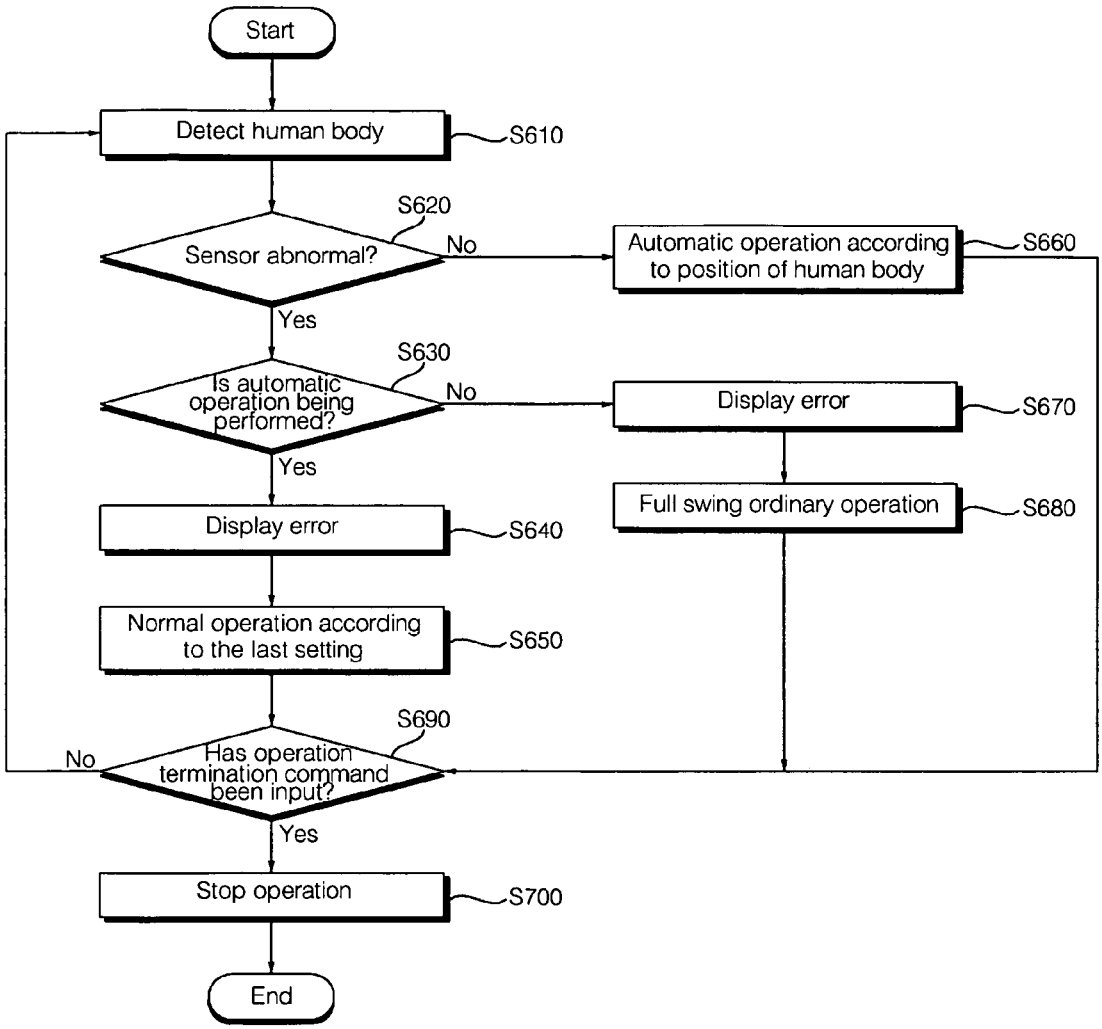
FIG. 5 is a flowchart showing an operation method depending on the occurrence of error during the automatic operation of the air conditioner according to an embodiment of the present invention.

FIG. 5 is a flowchart showing an operation method depending on the occurrence of error during the automatic operation of the air conditioner according to an embodiment of the present invention.

Referring to FIG. 5, in order for the automatic operation to be performed as in FIGS. 3 and 4 in the state where the automatic operation mode based on the detection of the human body has been set, there is need for data detected by the sensors of the human body detection unit 130 and the temperature detection unit 120.

In order for the air conditioner to perform a specific operation, not only indoor and outdoor temperature and a temperature of the refrigerant pipe, but also the pressure of the refrigerants need to be measured.

When the air conditioner operates in the automatic operation mode, the human body detection unit 130 rotatably operates and detects the human body while scanning an indoor area at step S610.

The control unit 110 determines whether, during the operation, the sensors included in the human body detection unit 130 are abnormal or the temperature sensors included in the temperature detection unit 120 are abnormal at step S620. Here, the control unit 110 may determine that the sensors are abnormal if measurement data is not received from the temperature detection unit 120, the human body detection unit 130, or detection means (not shown) including a pressure sensor, etc., input data exceeds a specific range, or a deviation in a measured data value exceeds a specific amount.

If, as a result of the determination, the sensors are determined not to be abnormal, the control unit 110 sets the direction of the wind according to the position of the detected human body and executes an automatic operation so that a current of air reaches the position of the detected human body at step S660.

However, if, as a result of the determination at step S620, the sensors are determined to be abnormal, the control unit 110 determines whether a current operation mode is an automatic operation at step S630. If, as a result of the determination, the current operation mode is determined to be the automatic operation, the control unit 110 displays error at step S670, terminates the automatic operation mode, and performs an ordinary operation of full swing at step S680.

If, as a result of the determination at step S630, the current operation mode is determined not to be the automatic operation because the automatic operation has been terminated or stopped, the control unit 110 displays error at step S640 and executes an ordinary operation according to the last setting at step S650.

Next, the control unit 110 maintains an operation according to each state or determines whether the sensors are abnormal until an operation termination command is input at step S690. The control unit 110 changes the existing operation based on the determination results at steps S610 to S690.

If, as a result of the determination at step S690, an operation termination command is determined to have been received, the control unit 110 stops the operation at step S700.

As described above, the present invention detects the human body and performs a preparation operation according to a detected indoor temperature or an automatic operation based on the detected human body. Accordingly, when a current of air is controlled according to the position of a person within a room, the current of air can be controlled more effectively. An operation of the air conditioner can operate according to a user's preference because an operation setting is changed according to a setting desired by the user. Further, when the sensors are abnormal, an automatic operation is terminated rather than providing a current of air based on an erroneous detection of the human body and an ordinary operation is performed. Accordingly, a more comfortable indoor environment can be provided to users.

While the present invention has been shown and described in connection with the exemplary embodiments thereof, those skilled in the art will appreciate that the present invention may be changed and modified in various ways without departing from the spirit and scope of the present invention as defined in the following claims.

What is claimed is:

1. An air conditioner, comprising: a temperature detection unit configured to detect an indoor temperature; a human body detection unit configured to rotatably operate and detect a person within an indoor area; a position determination unit configured to determine a position of the person based on data detected by the human body detection unit; and a control unit configured to control a current of air, wherein, the control unit performs an automatic operation for controlling a current of air according to the position of the person, which has been determined by the position determination unit, if the indoor temperature reaches a first reference temperature according to an entry of an automatic operation mode and performs a preparation operation for executing the automatic operation if the indoor temperature does not reach the first reference temperature, in the case where the automatic operation mode has been set, and stops the automatic operation and performs the preparation operation, if during the automatic operation, the indoor temperature reaches or exceeds a second reference temperature set higher than the first reference temperature, and wherein the control unit sets the volume of air to a maximum air volume and a direction of the wind to full swing so that the preparation operation is performed.

2. The air conditioner as claimed in claim 1, wherein, when the preparation operation is performed, the control unit sets a direction of a wind so that up and down discharge angles of the wind are horizontal to the surface of land.

3. The air conditioner as claimed in claim 1, wherein the control unit compares the indoor temperature and each of a first reference temperature and a second reference temperature which have been set according to a desired temperature and are fetched from a previously stored reference temperature table, wherein the first reference temperature is a temperature value which is a criterion for switching the preparation operation to the automatic operation, and the second reference temperature is a temperature value which is a criterion for switching the automatic operation to the preparation operation.

4. The air conditioner as claimed in claim 1, wherein, if at least one of termination conditions, including that the automatic operation mode is set in operation modes other than an air cooling mode, a supplementary function is set in the automatic operation mode, a sleep operation is set, and a direction of a wind or a volume of air is changed, is satisfied, the control unit terminates the automatic operation mode.

5. The air conditioner as claimed in claim 4, wherein, if a person within the indoor area is not detected by the human body detection unit, the control unit maintains a last operating state according to the automatic operation unless the automatic operation mode is terminated by any one of the termination conditions.

6. A method of operating an air conditioner, comprising the steps of: when an automatic operation mode is set, performing a preparation operation; if, during the preparation operation, an indoor temperature reaches a first reference temperature for entering an automatic operation according to a desired temperature, stopping the preparation operation and performing the automatic operation; while the automatic operation is being performed, detecting a person within an indoor area and calculating a position of the person; changing a direction of a wind or a volume of air and providing a current of air according to the position of the person; and the step of, if, during the automatic operation, the indoor temperature is equal to or higher than a second reference temperature which is a reference value for switching to the preparation operation and is set to be higher than the first reference temperature, stopping the automatic operation and performing the preparation operation and wherein the control unit sets the volume of air to a maximum air volume and a direction of the wind to full swing so that the preparation operation is performed.

7. The method as claimed in claim 6, further comprising the step of, if, before the step of performing the preparation operation, the indoor temperature is equal to or lower than the first reference temperature, performing the automatic operation without performing the preparation operation.

8. The method as claimed in claim 6, wherein the preparation operation is performed by a maximum air volume and through full swing according to the desired temperature.

9. The method as claimed in claim 6, further comprising the step of, in the step of calculating the position or the step of providing the current of air, if the indoor temperature is equal to or higher than a second reference temperature which is a reference value for switching to the preparation operation and is set to be higher than the first reference temperature, stopping the automatic operation and performing the preparation operation.

10. The method as claimed in claim 6, wherein the step of providing the current of air comprises controlling the current of air so that the current of air reaches an area corresponding to the position of the person when direct wind is set and the current of air reaches neighbor areas on the basis of the position of the person when indirect wind is set.

11. The method as claimed in claim 6, further comprising the step of, when the automatic operation mode is set, if at least one of termination conditions, including that the automatic operation mode is set in operation modes other than an air cooling mode, a supplementary function is set in the automatic operation mode, a sleep operation is set, and a direction of a wind or a volume of air is changed, is satisfied, terminating the automatic operation mode and performing an ordinary operation.

12. The method as claimed in claim 11, wherein, if a person is not detected within the indoor area while the step of calculating the position or the step of providing the current of air is performed, a last operating state according to the automatic operation is maintained unless the automatic operation mode is terminated by any one of the termination conditions.

13. The method as claimed in claim 6, further comprising the step of, if the automatic operation or the preparation operation is performed or changed according to the setting of the automatic operation mode or the automatic operation mode is terminated, outputting at least one of alarm, a warning flare, and a warning message.

* * * * *